United States Patent [19]

Voorhees

[11] 4,326,551

[45] Apr. 27, 1982

[54] HEAT RECOVERY SYSTEM FOR A DISHWASHER

[75] Inventor: John E. Voorhees, Sidney, Ohio

[73] Assignee: Hobart Corporation, Troy, Ohio

[21] Appl. No.: 200,857

[22] Filed: Oct. 27, 1980

[51] Int. Cl.[3] ..... B08B 3/02

[52] U.S. Cl. ..... 134/58 D; 134/107; 134/111

[58] Field of Search ..... 134/58 D, 105, 107–108, 134/111

[56] References Cited

U.S. PATENT DOCUMENTS

| | | | |
|---|---|---|---|
| 1,332,712 | 3/1920 | Couch | 134/105 X |
| 1,899,019 | 2/1933 | Deutsch | 134/111 X |
| 2,249,792 | 7/1941 | Skinner | 134/107 X |
| 4,134,003 | 1/1979 | Hahn | 134/58 D X |
| 4,156,621 | 5/1979 | Andrews | 134/108 X |
| 4,254,788 | 3/1981 | Helwig, Jr. | 134/108 X |

*Primary Examiner*—Robert L. Bleutge
*Attorney, Agent, or Firm*—Biebel, French & Nauman

[57] ABSTRACT

A heat exchanger is used in combination with a dishwasher of the type having a sump, a washing spray assembly, a circulating pump which pumps washing fluid from the sump through the washing spray assembly, a rinsing spray assembly, a source of fresh rinsing water which flows through the rinsing assembly, a booster heater for heating the rinsing water to a predetermined temperature and a drain line for draining excess washing solution from the sump. The heat recovery system includes a heat exchanger in which fresh rinsing water flows in heat exchange relation with the excess washing solution from the sump before the rinsing water reaches the booster heater. A rinse valve controlling the flow of rinsing water cooperates with a pump located on the drain line so that the rinsing water and the washing solution flow through the heat exchanger at only preselected times during the operating cycle of the dishwasher. The dishwasher includes a control which activates the pump and the rinse valve whenever articles within the dishwasher are in position to be sprayed with rinsing water.

12 Claims, 3 Drawing Figures

HEAT RECOVERY SYSTEM FOR A DISHWASHER

BACKGROUND OF THE INVENTION

1. Field of the Invention

The present invention relates to dishwashing equipment and, more particularly, to an improved dishwashing machine in which excess heated washing solution is used to preheat the incoming rinsing water as the excess solution is routed to the drain.

2. Prior Art

In a typical commercial dishwasher, fresh water is first heated and then circulated through the rinsing system to rinse the foodware items. In order to conserve water and heat in such dishwashers, this heated rinsing water is then collected in a sump, supplementing the water already therein which along with detergent forms the washing solution. In this fashion, the solution in the sump need only be heated a small amount in order to reach the requisite sanitizing temperature to replace the heat lost to the foodware items. Excess washing solution now in the sump overflows from the sump into an overflow standpipe through which it is drained from the dishwasher as waste water.

A large amount of the energy used to operate commercial dishwashers of this type is directed to heating the fresh water flowing into the rinsing system and maintaining the temperature of the washing solution as it is held in the sump. A substantial amount of heat energy is lost in the heated solution which overflows from the sump to the drain and out of the dishwasher. Some devices have been proposed in the prior art to recapture the heat energy stored in the heated water within the sump of a commercial dishwasher and thereby reduce the amount of energy required to operate the dishwasher. One method has been to use the heated water from the sump to preheat the fresh water used for rinsing prior to its entering a water heater from which heated rinsing water is supplied to the dishwasher so that the water heater does not have to use a large amount of energy to heat the rinsing water to the required temperature.

For example, in U.S. Pat. No. 1,332,712, the line which supplies fresh water for rinsing to the water heater passes through the sump which contains heated water used for washing. The section of line passing through the sump is coiled to increase the surface area of the line in contact with the solution.

The primary disadvantage is that the heat energy being removed from the washing solution to preheat the rinsing water is being removed from washing solution contained within the sump. Since the washing solution in the sump must be maintained at a temperature sufficient to sanitize the foodware items, heat energy must be added to the water in the sump from an external source to compensate for the heat removed by the fresh water passing through. Thus, there is a trade-off which might not result in any actual savings in energy for this type of device.

A secondary disadvantage of such heat recovery systems is that the washing solution typically contains food particles of varying sizes which may deposit on the coils of the rinse line and thereby impair the heat transfer capability of the coil. This is especially true if a heat exchanger having a multiplicity of finely spaced fins is used instead of a coil.

A second example is found in U.S. Pat. No. 4,156,621. Used heated rinsing solution from the sump of a commercial dishwasher is first pumped into holding tanks. By use of auxiliary pumps the solution is then pumped through reverse osmosis and softening units for regeneration back to reusable quality and therefrom pumped back to the holding tanks. At the holding tanks, the regenerated water passes through immersed heat exchanger coils through which the cooler regenerated water absorbs heat energy from used heated rinsing solution stored in the tanks. The regenerated and now preheated rinsing water then flows to a booster heater from which it is pumped for use in rinsing the foodware items in the dishwasher.

One drawback to the use of this system solely for heat energy recovery from used heated rinsing water is in its implication that temporary holding tanks be provided for receiving the used heated rinsing water. The additional investment in equipment and space for the equipment alone would greatly diminish the viability of this system as a feasible approach to energy recovery. Another disadvantage is the low heat transfer efficiency of immersed coil type heat exchangers.

These two examples of prior art attempts at heat energy recovery from used heated dishwasher water are not seen as satisfactory approaches to the goal of energy convervation. Accordingly, the need still exists for a viable heat recovery system for a dishwasher in which heat energy contained in the used water or washing solution being drained from the dishwasher is transferred at high efficiency rates to the cooler fresh water to be used for rinsing in the dishwasher so that minimal supplemental energy is required to be added to the rinsing water to heat it to the requisite temperature. Such a system should not remove heat from the washing solution held within the sump in order to heat the rinsing water.

SUMMARY OF THE INVENTION

The present invention provides an improved heat recovery system in which a substantial portion of the heat energy contained in the heated washing solution drained from the sump of a dishwasher as waste water is transferred to the cooler water supplied for rinsing. Unlike some prior art attempts at heat recovery in which heat energy is merely transferred from one portion of the system to another, the system of the present invention actually recovers heat energy from heated washing solution that is drained from the dishwasher and otherwise would be lost, thereby reducing the total amount of energy required to operate the dishwasher.

In addition, the heat recovery system of the present invention does not require coils or other heat transfer apparatus to be placed in the sump of the dishwasher or other auxiliary holding tanks where it might become clogged with food or require relatively large and costly filtering screens to encase the coil or apparatus. In the present invention, heated excess washing solution is pumped from the wash chamber of the dishwasher through a heat exchanger separate from the dishwasher wash chamber where the heat transfer process occurs before the used excess solution passes into the drain.

The heat recovery system of the present invention is designed to be integrated into a typical commercial dishwasher having a wash chamber with a sump at its bottom, a pump and washing assembly for circulating and spraying the washing solution from the sump onto foodware items within the wash chamber, a drain line communicating with the wash chamber, a source of fresh rinsing water, a booster heater for heating the rinsing water, and a rinsing spray assembly communicating with the booster heater for spraying rinsing water on washed foodware items within the wash chamber. The heat recovery system includes a preheating means for flowing the washing solution from the wash chamber into heat exchange relation with the fresh rinsing water, a rinse valve for controlling the flow of rinsing water from the source through the preheating means and the rinsing means, a pump for pumping washing solution from the wash chamber through the preheating means and then to the drain, and a control which energizes the pump and rinse valve such that the rinsing water and washing solution flow through the preheating means during spraying of the foodware items with rinsing water.

The preheating means is preferably a high-efficiency counterflow-type heat exchanger and in a preferred embodiment is a multiple-pass, plate-type heat exchanger. Also in the preferred embodiment of the present invention, the heat exchanger communicates with the sump of the wash chamber by a drain pipe having a mouth which is elevated from the floor of the sump to slightly below the operational water level in the sump. In order to prevent the heat exchanger from becoming clogged, the mouth is encased in a filter, preferably having openings approximately 1 mm in diameter. Spray jets are mounted proximate the filter and communicate with the washing solution pump so that washing solution is sprayed over the screen to keep it free from food particles that would block the openings in the filter.

A second means for preventing the heat exchanger from becoming clogged is present in the preferred embodiment. The heat exchanger is fitted with valves so that the flow of the fresh rinsing water and the flow of the washing solution through the heat exchanger can be reversed. In this fashion, food and other particles which might become lodged within the heat exchanger can be removed while maintaining the high efficiency of a counterflow-type heat exchanger. The valves preferably are controlled by a timer mechanism which would periodically reverse the flow of rinsing water and washing solution through the heat exchanger.

The control means which energizes the rinse valve and the pump so that rinsing water and washing solution flow through the heat exchanger, preferably consists of a rack sensing switch located within the wash chamber of the dishwasher. When a rack of washed foodware items enters the vicinity of the rinsing water spraying assembly, it actuates the rack sensing switch, thereby activating the drain pump and the rinse valve so that rinsing water and heated washing solution flow through the heat exchanger. In this fashion, heated excess washing solution is drained from the wash chamber and used to heat the incoming rinsing water only as needed so that the washing solution is at all times substantially contained within the sump rather than holding tanks or coils, thereby reducing heat loss without need of expensive insulation.

In a second embodiment of the invention, the heat recovery system includes a second source of heated water for the heat exchanger. A catchpan is positioned within the washing chamber below the rinsing spray assembly and above the operational water level of the sump. The catchpan communicates with the drain pump which pumps washing solution along with the used rinsing water flowing from the catchpan to the heat exchanger. During the rinsing cycle of the dishwashing operation, the catchpan collects some of the rinsing water sprayed from the rinsing spray assembly which is at a higher temperature than the water collected in the sump of the dishwasher. Since the water is at a higher temperature, there is more heat energy available to be transferred to the incoming fresh rinsing water.

There is no need to include a spray nozzle arrangement with the catchpan since it is positioned below the rinsing spray assembly and the food articles passing into the rinse area have been cleaned of all substantial food particles. Since this source of used fluid for the heat recovery system has fewer food particles and less dissolved fat and grease, the rate of build-up of soil within the heat exchanger is reduced. In some applications of the invention, this may obviate the need for reversing the flow through the heat exchanger periodically and eliminate the need of the valves and timer mechanism of the preferred embodiment.

Although the heat recovery system of the present invention can be adapted to be incorporated into any dishwashing system, it has been tested with several commercial dishwashers manufactured by the assignee of the present invention. In such tests, the energy required for a dishwashing cycle has been reduced by as much as 58 percent.

Accordingly, it is an object of the present invention to provide a heat recovery system for a dishwasher in which the incoming fresh rinsing water is preheated by the heated washing solution after it leaves the wash chamber of the dishwasher but before it reaches the drain so that the overall energy requirements of the dishwasher are reduced; to provide a heat recovery system in which the heat exchanging apparatus is outside of the dishwashing chamber so that heat required by the washing solution in use is not lost and, additionaly, so that build-up of food soil particles on the heat exchanging apparatus is eliminated; to provide a heat recovery system in which a relatively inexpensive and uncomplicated filtering apparatus can be used to filter the excess wash solution pumped from the dishwasher to the heat exchanger apparatus so as to minimize the possiblity of build-up of food soil particles within the heat exchanger; and to provide a heat recovery system in which the heated washing solution is otherwise substantially contained within the sump of the dishwasher to minimize heat loss and only drained from the wash chamber for use in heat recovery as needed and when present in excess quantities in the wash chamber.

Other objects and advantages of the invention will be apparent from the following description, the accompanying drawings, and the appended claims.

DETAILED DESCRIPTION OF THE PREFERRED EMBODIMENT

Figure 1:
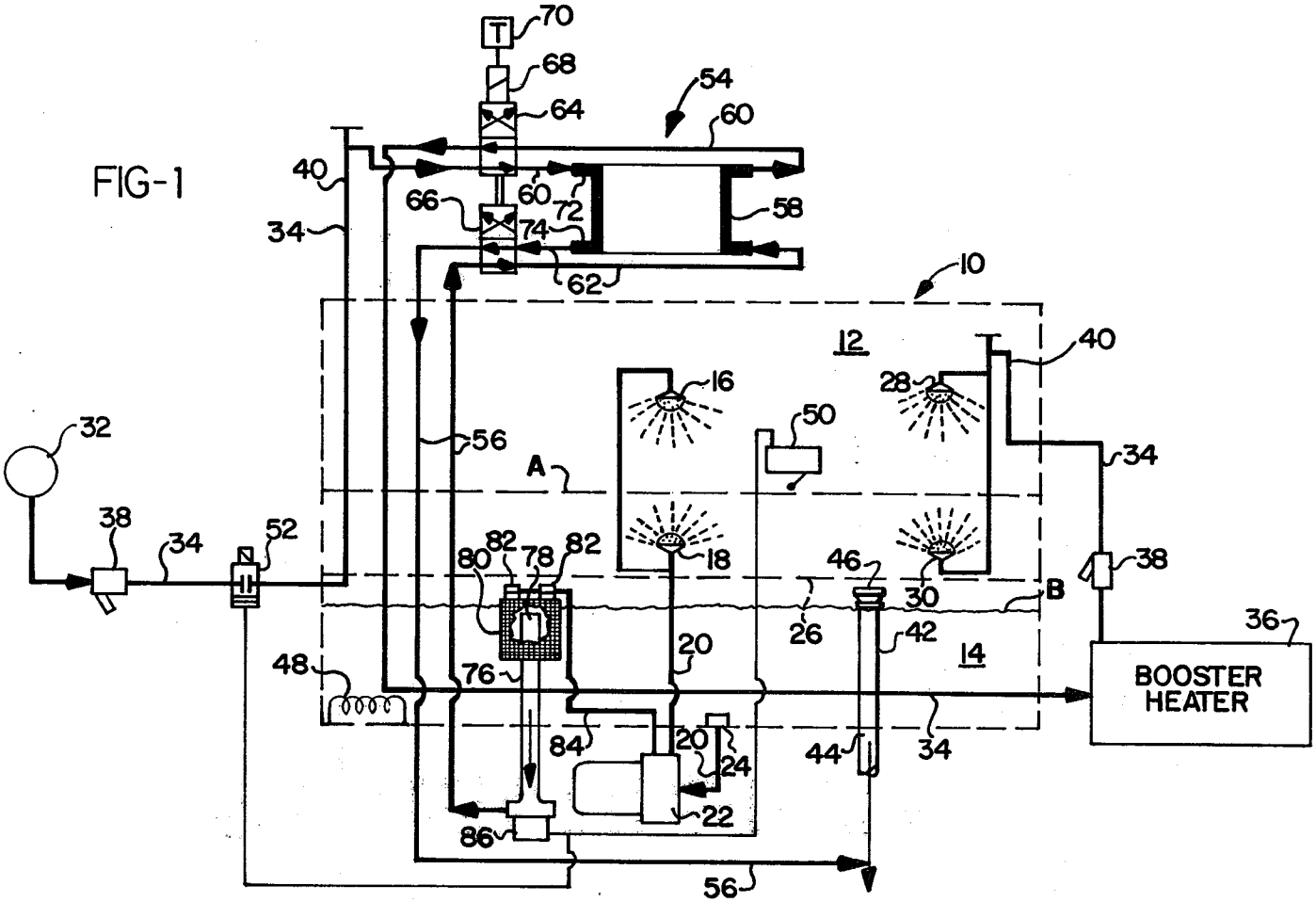
FIG. 1 is a generally schematic representation of the present invention.

As shown in FIG. 1, the heat recovery system of the present invention may be incorporated into a typical commercial dishwasher, generally designated 10. An example of such a dishwasher is disclosed in any one of U.S. Pat. Nos. 2,073,521; 2,974,672; 3,067,757; or 3,414,114 issued to the assignee of the present invention. The dishwasher 10 has a wash chamber 12 which includes a sump 14.

Within the wash chamber 12 above the sump 14 is mounted a means for spraying the washing solution over soiled articles supported in the wash chamber, such as upper washing assembly 16 and lower washing assembly 18. Upper and lower washing assemblies 16, 18 are positioned to be above and below a conveyor system which transports soiled foodware articles, typically in trays or racks, and denoted by the broken line A. Such conveyor systems are well-known in the art. Upper and lower washing assemblies 16, 18 are supplied with washing solution through a means for circulating the washing solution which includes washing supply line 20 and a wash pump 22 mounted on the supply line. Washing supply line 20 draws washing solution from the sump 14 through a mouth 24 located below perforated strainers represented by broken line 26.

The typical dishwasher 10 also includes within its wash chamber 12 a means for spraying fresh rinsing water which includes an upper rinsing spray assembly 28 and a lower rinsing spray assembly 30 mounted above and below the conveyor line A in a manner similar to that of the upper and lower washing assemblies 16, 18. Upper and lower rinsing spray assemblies 28, 30 are supplied with fresh rinsing water from a source of fresh water under pressure 32 by means of a rinsing supply line 34. Rinsing supply line 34 passes through a means for heating the rinsing water such as a booster heater 36 so that the rinsing water can be heated to a predetermined temperature, typically 180° F. Rinsing supply line 34 may also include various line strainers 38 and vacuum breakers 40 which may be required by local sanitation codes and for other purposes.

The wash chamber 12 also includes a drain standpipe 42 which drains into a drain line 44. The drain standpipe 42 has a mouth 46 which is located approximately 2 inches above the water level, denoted by solid line B, of the washing solution within the sump 14.

The sump 14 typically includes a means for maintaining the washing solution at a relatively high washing temperature, usually a heating coil 48 activated by a thermostat (not shown).

The upper and lower rinsing spray assemblies 28, 30 are activated by control means such as a rack sensing switch 50 which operates rinse valve 52 located on rinsing supply line 34 upstream of booster heater 36. Thus, when a rack of washed foodware articles (not shown) enters the region of the upper and lower rinsing spray assemblies 28, 30, the rack sensing switch 50 is actuated, thereby opening rinse valve 52 and allowing rinsing water from the source 32 to flow through rinsing supply line 34 and booster heater 36 to the spray assemblies, with the rinsing water flowing to the spray assemblies being heated to the appropriate rinsing temperature by booster heater 36. Once the rack of articles has been moved clear of switch 50, the switch automatically de-actuates, thereby closing rinse valve 52 and shutting off the flow of rinsing water.

The heat recovery system of the present invention consists of a preheating means, generally designated 54, which communicates with rinsing water supply line 34 and the washing chamber 12 of dishwasher 10 by means of heat recovery line 56. The preheating means 54 includes a heat exchanger 58 which preferably is a multiple-pass, counterflow, plate-type heat exchanger of the type disclosed in U.S. Pat. Nos. 2,865,613 or 2,787,446. Heat exchanger 58 has a first distinct fluid pathway 60 through which rinsing water from the source 32 flows to the booster heater 36, and a second distinct fluid pathway 62 through which washing solution from the sump 14 flows to the drain line 44. In the plate-type heat exchanger of the preferred embodiment, the first and second fluid pathways 60, 62 are substantially parallel to each other.

Figure 2:
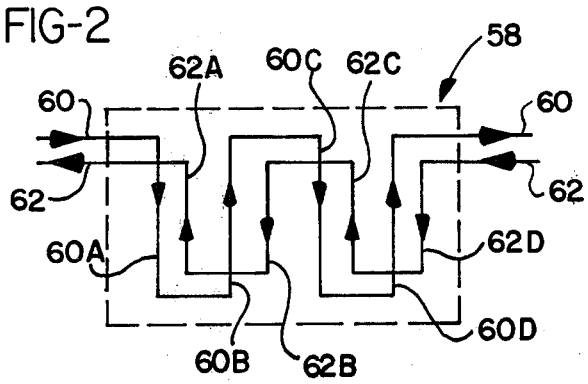
FIG. 2 is an enlarged top plan diagrammatic view of the fluid pathways through the heat exchanger.

In the diagrammatic representation of the heat exchanger 58 in FIG. 2, the fluid pathways 60 and 62 are depicted in offset relationship to one another for purposes of clarity of illustration. In actuality, the entrance and exit of the fresh rinsing water pathway 60 to and from the heat exchanger 58 are located directly above the exit and entrance, respectively, of the washing solution pathway 62 from and to the heat exchanger 58, as seen in FIG. 1. Furthermore, each fresh rinsing water pathway branch 60A, 60B, 60C, and 60D constitutes a single pass comprised of nine parallel unidirectional flow paths. These nine rinsing water flow paths alternate with another nine parallel and unidirectional flow paths which constitute a single pass for each of branches 62A, 62B, 62C and 62D of the washing solution pathway 62. This arrangement of flow paths produces the counterflow relationship between the cold rinsing water and heated washing solution in respective pathways 60 and 62. The exemplary embodiment of the heat exchanger 58 depicted in FIG. 2 has four passes comprised by seventy-three plates, each having a configuration such as seen in the aforementioned 2,865,613 or 2,787,446 patents. Also, the portions of the pathways which are parallel to the entrances and exits and interconnect adjacent branches of the respective pathways 60 and 62 alternate between upper and lower aligned positions with respect to one another.

The preheating means 54 further includes a first valve means 64 which communicates with the first fluid pathway 60 of the heat exchanger 58, and a second valve means 66 which communicates with the second fluid pathway 62. The valve means 64, 66 are both four-way valves and are activated by a motordriven mechanism 68 which is controlled by a timer 70. The first valve means 64 communicates with the first fluid pathway 60 through a first inlet port 72 located on the heat exchanger 58. Similarly, the second valve means 66 communicates with the second inlet port 74, also located on the heat exchanger 58.

The heat recovery line 56 receives washing solution from the sump 14 through a drain pipe 76 which extends upwardly from the bottom of the sump. The drain pipe 76 includes a mouth 78 which is slightly below the water line A and is enclosed in a filter screen 80 to prevent food particles from entering the heat recovery line 56. In order to prevent the openings in filter screen 80 from becoming clogged with food soil particles, the filter screen includes two spray nozzles 82 which have openings directed onto the screen. The spray nozzles 82 spray washing solution onto the filter screen 80 which is pumped from the sump 14 by wash pump 22 through spraying line 84.

Drain pipe 76 terminates in drain pump 86 which pumps washing solution through heat recovery line 56 to second valve means 66. It is desirable to position the drain pump 86 below the sump 14 so that washing solution will flow by gravity to the pump and avoid cavitation.

From second valve means 66 the washing solution travels through the second fluid pathway 62 in the heat exchanger 58 and continues through heat recovery line 56 which eventually joins drain line 44. The drain pump 86 is activated by the rack sensing switch 50 so that it operates simultaneously with rinse valve 52. Thus, heated washing solution flows from the dishwasher and through the heat recovery system only upon overflow of excess solution from the sump 14 when the rinsing water is flowing through the rinsing supply line 34 to the booster heater 36 and therefrom to the wash chamber 12 through upper and lower rinsing spray assemblies 28, 30. In such manner, heat is recovered only from the drained washing solution and not from the solution in the sump as would occur if heated washing solution was at all times circulating from the sump 14 through the preheating means 54.

The operation of the heat recovery system is as follows. Before the soiled foodware items are placed within the washing chamber 12 to be washed, the sump 14 is filled with washing solution to line B and heating coil 48 is activated to heat the washing solution to a predetermined temperature, typically 160° F. Racks of soiled foodware items are placed on the conveyor system (not shown), designated by line A, and travel from left to right as shown in FIG. 1. The racks pass between the upper and lower washing assemblies 16, 18, the foodware items are cleaned and the food soil particles are caught on strainer 26 or washed into the sump 14. As the rack enters the area between the upper and lower rinsing spray assemblies 28, 30, the rack sensing switch 50 is actuated thereby activating the rinse valve 52 and the drain pump 86. Simultaneously, fresh rinsing water at approximately 55° F. flows from the source 32 through rinsing supply line 34 to the first valve means 64 and drain pump motor 86 draws washing solution through the mouth 78 of the drain pipe 76 and pumps it through heat recovery line 56 to the second valve means 66. From valve means 64, 66, the rinsing water and the heated washing solution flow through the substantially parallel pathways 60, 62 of the heat exchanger 58. The washing solution then exits the heat exchanger 58, flows back through second valve means 66, and continues along the heat recovery line 56 until it reaches drain line 44. The rinsing water exits the heat exchanger 58, flows back through first valve means 64, and continues along rinsing supply line 34 to booster heater 36. Typically, the temperature of the rinsing water exiting the heat exchanger 58 of the preferred embodiment is approximately 140° F. and the booster heater is required only to heat the rinsing water an additional 40° F. before the rinsing water reaches the upper and lower rinsing spray assemblies 28, 30 where it is sprayed upon the foodware items within the rack.

After a prolonged number of washing and rinsing cycles have occurred, the heat exchanger 58 may lose some efficiency as a result of accumulations of grease and fine food soil particles which may accumulate along the second fluid pathway 62. To safeguard against this happening, the timer 70 is provided for periodically activating the motordriven mechanism 68 to shift the first and second valve means 64, 66 to reverse the respective flows of fresh rinsing water and washing solution through the first and second fluid pathways 60, 62, thereby flushing any accumulation of food soil and other deposits from the heat exchanger 58. It is desirable to reverse the flow of the rinsing water through the heat exchanger as well as the washing solution in order to preserve the high efficiency counterflow configuration of the first and second fluid pathways 60, 62.

Figure 3:
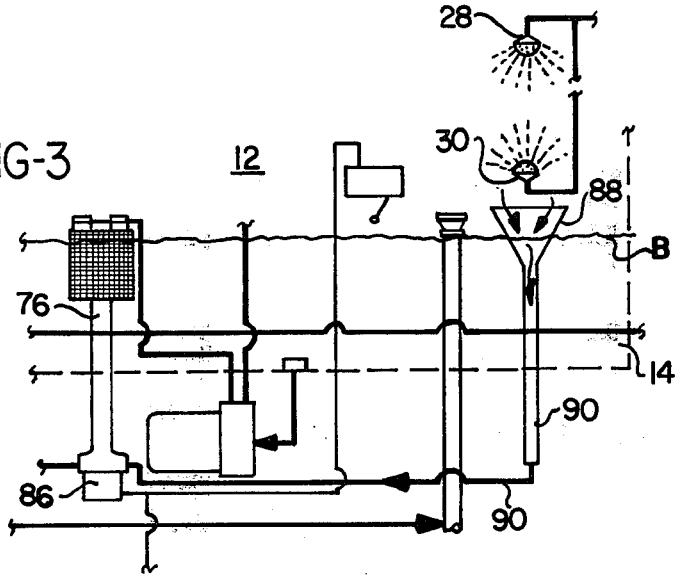
FIG. 3 is an alternate embodiment of the invention showing the addition of a rinsing water catchpan beneath the upper and lower rinsing spray assemblies.

In a second embodiment, shown in FIG. 3, some of the heated rinsing water sprayed on foodware items is collected before the water mixes with the washing solution in the sump 14. The collected water is then mixed with excess washing solution and pumped to the preheating means. It should be noted that all of the elements of the dishwasher, as well as the elements of the heat recovery system defined in the previous embodiment, are present in this embodiment and so the same reference numerals are used in FIG. 3 as in FIG. 1 to denote like elements. The heat recovery system in FIG. 3 includes a rinsing water catchpan 88 which is positioned within the sump 14 of the washing chamber 12 above the water line B and directly below the upper and lower rinsing spray assemblies 28, 30. The catchpan 88 communicates with the drain pump 86 by means of auxiliary line 90. Thus, drain pump 86 will pump a mixture of hot water from the rinsing assemblies 28, 30 and heated washing solution from drain pipe 76 to the heat exchanger. If the drain pipe 76 and auxiliary line 90 are sized such that the mixture pumped by drain pump 86 is approximately 2.5 parts of rinsing water to one part of washing solution, the temperature of the heated water supplied to the heat exchanger is approximately 165° F., given the initial temperatures used in discussing the operation of the previous embodiment. As a result, the rinsing water which exits the heat exchanger and flows to the booster heater has a higher temperature, approximately 144° F., thus further reducing the energy required to heat the rinsing water up to the predetermined temperature which is normally 180° F.

The present invention provides numerous advantages over prior art heat recovery systems. The present invention provides a relatively compact unit that utilizes a common drain line and does not require additional external storage or holding tanks. Heated washing solution, which is used as a source of heat energy to preheat the incoming rinsing water, is stored in the sump of the wash chamber until the start of the rinsing cycle when it is pumped to the heat exchanger.

Unlike prior art devices which merely transfer heat energy from one part of the dishwashing system to another, the invention effects a true energy savings in that heated excess washing solution which has heretofore directly overflowed to the drain first passes through a heat exchanger to transfer heat energy to the cooler rinsing water flowing into a booster heater for use in the rinsing operation. Thus, the total amount of heat energy required to operate the dishwashing system is substantially reduced.

In addition, continued use of the heat exchanger will not result in reduced performance caused by build-up of food soil. The heat exchanger is not immersed in the heated washing solution, as with some prior art heat recovery systems, where it might become encrusted with food soil or require large and costly filter apparatus. Rather, the heat exchanger is located externally of the wash chamber, preferably above it, and the heated washing solution is pumped from the sump through a conduit to the heat exchanger. The conduit requires only a small filter to cover its mouth. To further reduce the likelihood of the heat exchanger becoming clogged, the preheating means includes timer-controlled valves to reverse the flow through the heat exchanger periodically thereby dislodging built-up food soil.

While the apparatus herein described constitute preferred embodiments of the invention, it is to be understood that the invention is not limited to these precise forms of apparatus, and that changes may be made therein without departing from the scope of the invention.

What is claimed is:

1. A dishwasher of the type having a wash chamber with a sump at its bottom for containing a quantity of washing solution, means for maintaining the washing solution in the sump at a relatively high washing temperature, means for spraying the washing solution over soiled articles supported in the wash chamber, means for circulating the solution from the sump to the washing solution spraying means, a drain line for the washing solution, a pressurized source of fresh rinsing water at an initial temperature substantially below said washing temperature, means for heating the fresh rinsing water to a predetermined rinsing temperature substantially higher than said initial temperature, and means for receiving fresh rinsing water from the rinsing water heating means and spraying the fresh rinsing water at said rinsing temperature over the articles after they have been sprayed with the washing solution, wherein the improvement comprises:

preheating means for flowing the washing solution from the sump in heat exchange relation with, but separated from, the fresh rinsing water before the rinsing water reaches the rinsing water heating means such that the rinsing water is preheated by the washing solution;

rinse valve means for controlling the flow of fresh rinsing water from said source thereof, through said preheating means and to the rinsing water spraying means;

pump means for pumping washing solution from the wash chamber, through said preheating means and then finally to said drain line after heat exchange with the fresh rinsing water; and control means for energizing said pump means and energizing said rinse valve means such that rinsing water and washing solution flow through said preheating means during spraying of articles with the rinsing water.

2. The dishwasher of claim 1 wherein said preheating means includes a heat exchanger having first and second distinct fluid pathways separated by heat conducting material, the fresh rinsing water travelling from the source thereof through said first distinct fluid pathway to the means for heating the rinsing water, and the washing solution travelling from the sump through said second distinct fluid pathway to said drain line.

3. The dishwasher of claim 2 wherein said first and second distinct fluid pathways are substantially parallel to one another, with the rinsing water travelling through said first pathway in a first direction and the washing solution travelling through said second pathway in a second direction opposite to said first direction.

4. The dishwasher of claim 2 wherein said preheating means further includes first and second valve means communicating with said first and second fluid pathways, respectively, such that the flow directions of the rinsing solution and the washing solution through said respective first and second pathways of said heat exchanger can be reversed.

5. The dishwasher of claim 4 wherein said preheating means further includes a timer means for operating said first and second valve means to reverse the flow directions of the rinsing water and the washing solution through said first and second pathways, respectively, at predetermined intervals.

6. The dishwasher of claim 2 wherein said preheating means further includes:

a first drain pipe located in the sump and having a mouth;

filter means covering said mouth to prevent particles suspended in the washing solution in the sump from entering said mouth; and filter spray means communicating with at least one of the circulating means and pump means for directing a spray of washing solution upon the external surface of said filter means to flush the suspended particles therefrom.

7. The dishwasher of claim 6 further comprising a second drain pipe for overflow draining of the washing solution from the wash chamber sump and having an upper opening and being positioned withinthe sump such that said opening is above said mouth of said first drain pipe.

8. The dishwasher of claim 2 wherein said preheating means further includes:

a first inlet port in said heat exchanger;

a rinsing water feed line extending from said source of fresh rinsing water to said first inlet port in said heat exchanger and communicating with said first pathway; and said rinse valve means being located in said fresh rinsing water feed line.

9. The dishwasher of claim 8 wherein said preheating means further includes:

a second inlet port in said heat exchanger;

a washing solution feed line extending from said first drain pipe to said second inlet port in said heat exchanger and communicating with said second pathway;

said heat exchanger being mounted above the wash chamber; and said pump means being mounted in said washing solution feed line adjacent the wash chamber sump such that a quantity of washing solution is normally contained in said washing solution feed line so that said pump means is normally primed with washing solution.

10. A dishwasher of the type having a wash chamber with a sump at its bottom for containing a quantity of washing solution, means for maintaining the washing solution in the sump at a relatively high washing temperature, means for spraying the washing solution over soiled articles supported in the wash chamber, means for circulating the solution from the sump to the washing solution spraying means, a drain line for the washing solution, a pressurized source of fresh rinsing water at an initial temperature substantially below said washing temperature, means for heating the fresh rinsing water to a predetermined rinsing temperature substantially higher than said initial temperature, and means for receiving fresh rinsing water from the rinsing water heating means and spraying the fresh rinsing water at said rinsing temperature over the articles after they have been sprayed with the washing solution, wherein the improvement comprises:

preheating means for flowing the washing solution from the sump in heat exchange relation with, but separated from, the fresh rinsing water before the rinsing water reaches the rinsing water heating means such that the rinsing water is preheated by the washing solution;

rinse valve means for controlling the flow of fresh rinsing water from said source thereof, through said preheating means and to the rinsing water spraying means; and pump means for pumping washing solution from the wash chamber, through said preheating means and then finally to said drain line after heat exchange with the fresh rinsing water;

said preheating means including a heat exchanger having first and second distinct fluid pathways separated by heat conducting material, the fresh rinsing water travelling from the source thereof through said first distinct fluid pathway to the means for heating the rinsing water, and the washing solution travelling from the sump through said second distinct fluid pathway to said drain line, said first and second distinct fluid pathways being substantially parallel to one another, with the rinsing water travelling through said first pathway in a first direction and the washing solution travelling through said second pathway in a second direction opposite to said first direction; and said preheating means further including first and second valve means communicating with said first and second fluid pathways, respectively, such that the flow directions of the rinsing solution and the washing solution through said respective first and second pathways of said heat exchanger can be reversed.

11. A dishwasher of the type having a wash chamber with a sump at its bottom for containing a quantity of washing solution, means for maintaining the washing solution in the sump at a relatively high washing temperature, means for spraying the washing solution over soiled articles supported in the wash chamber, means for circulating the solution from the sump to the washing solution spraying means, a drain line for the washing solution, a pressurized source of fresh rinsing water at an initial temperature substantially below said washing temperature, means for heating the fresh rinsing water to a predetermined rinsing temperature substantially higher than said initial temperature, and means for receiving fresh rinsing water from the rinsing water heating means and spraying the fresh rinsing water at said rinsing temperature over the articles after they have been sprayed with the washing solution, wherein the improvement comprises:

preheating means for flowing the washing solution from the sump in heat exchange relation with, but separated from, the fresh rinsing water before the rinsing water reaches the rinsing water heating means such that the rinsing water is preheated by the washing solution;

pump means for pumping washing solution from the wash chamber, through said preheating means and then finally to said drain line after heat exchange with the fresh rinsing water;

said preheating means including a heat exchanger having first and second distinct and substantially parallel fluid pathways separated by heat conducting material, the rinsing water travelling from the source thereof through said first distinct fluid pathway in a first direction to the means for heating the rinsing water and the washing solution travelling from the sump through said second distinct fluid pathway in a second direction, being opposite to said first direction, to the drain line, first and second valve means communicating with first and second fluid pathways, respectively, such that the flow directions of the rinsing solution and the washing solution through said respective first and second pathways of the heat exchanger can be reversed, a first drain pipe located in the sump and having a mouth, filter means covering said mouth to prevent particles suspended in the washing solution in the sump from entering said mouth, filter spray means communicating with at least one of the pump means and circulating means for directing a spray of washing solution upon the external surface of said filter means to flush the suspended particles therefrom, a first inlet port in said heat exchanger, a rinsing water feed line extending from said source of rinsing water to said first inlet port in said heat exchanger and communicating with said first pathway, a second inlet port in said heat exchanger, a washing solution feed line extending from said first drain pipe to said pump means and therefrom to said second inlet port in said heat exchanger communicating with said second pathway, said pump means being mounted in said washing solution feed line adjacent the wash chamber sump such that a quantity of washing solution is normally contained in said washing solution feed line so that said pump means is normally primed with washing solution;

rinse valve means mounted in said rinsing water feed line for controlling the flow of rinsing water from said source thereof, through said preheating means and to the rinsing water spraying means; and control means for energizing said pump means and energizing said rinse valve means such that rinsing water and washing solution flow through said preheating means during spraying of articles with rinsing water.

12. The dishwasher of claim 11 wherein said heat exchanger is mounted above the wash chamber.

* * * * *